US006185813B1

(12) United States Patent
Donnola

(10) Patent No.: US 6,185,813 B1
(45) Date of Patent: Feb. 13, 2001

(54) ENHANCED VARISTOR-BASED LIGHTING ARRESTERS

(75) Inventor: Jean-Michel Donnola, Villecomtal-sur-Arros (FR)

(73) Assignee: Soule Materiel Electrique (FR)

( * ) Notice: Under 35 U.S.C. 154(b), the term of this patent shall be extended for 0 days.

(21) Appl. No.: 09/171,217

(22) PCT Filed: Apr. 10, 1997

(86) PCT No.: PCT/FR97/00637

§ 371 Date: May 27, 1999

§ 102(e) Date: May 27, 1999

(87) PCT Pub. No.: WO97/39462

PCT Pub. Date: Oct. 23, 1997

(30) Foreign Application Priority Data

Apr. 12, 1996 (FR) ..... 96 04588

(51) Int. Cl.[7] ..... H01C 17/02

(52) U.S. Cl. ..... 29/613; 361/117; 338/21

(58) Field of Search ..... 338/21, 13, 14, 338/15, 20; 361/117, 126–128, 130, 119, 120, 331, 420; 174/178; 29/613, 611, 610.1

(56) References Cited

U.S. PATENT DOCUMENTS 3,018,406 1/1962 Innis et al. .
4,656,555 * 4/1987 Raudabaugh ..... 361/117
5,497,138 * 3/1996 Malpiece et al. ..... 338/21

FOREIGN PATENT DOCUMENTS 0397163 11/1990 (EP) .
0443286 8/1991 (EP) .
0549432 6/1993 (EP) .
2258352 2/1993 (FR) .
2698736 6/1994 (FR) .

* cited by examiner

*Primary Examiner*—Lee Young
*Assistant Examiner*—Sean Smith
(74) *Attorney, Agent, or Firm*—Blakely Sokoloff Taylor & Zafman

(57) ABSTRACT

The present invention relates to a method of manufacturing a lightning arrester, the method being of the type comprising steps consisting in making a stack of varistors (100), and in forming a cover (300) made of a composite material over the stack of varistors (100), said method being characterized by the fact that the step of forming a cover (300) made of a composite material consists in placing a woven fiber fabric (310) on the outside of the stack of varistors (100) and in contact therewith, in placing a flexible outer cover (400) on the outside of the stack of varistors (100), and in injecting a material (350) suitable for impregnating the fiber fabric (310) into the annular space formed between the stack of varistors (100) and the flexible outer cover (400).

31 Claims, 2 Drawing Sheets

ENHANCED VARISTOR-BASED LIGHTING ARRESTERS

Figure 1:
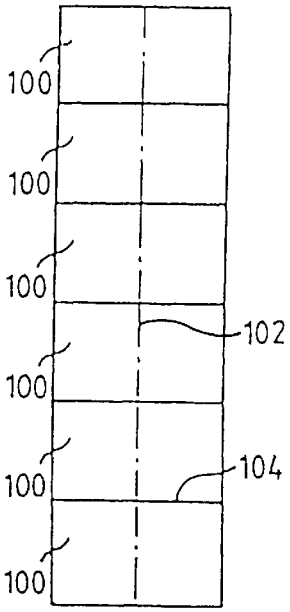

The present invention relates to the field of lightning arresters.

It is particularly applicable to lightning arresters for high voltages, typically in electricity networks having a nominal r.m.s. voltage between phases that is greater than 1 kV.

Lightning arresters are devices designed to be connected between ground and an electricity line, in particular a medium-voltage line or a high-voltage line, so as to limit the amplitude and the duration of any voltage surges that appear on the line.

Such voltage surges may, for example, be due to atmospheric phenomena such as lightning or induction in the conductors.

Such voltage surges may also be due to operations being performed on the line while it is live.

In general, a lightning arrester is formed by a stack of various varistors, the stack usually nowadays being a stack of disks based on zinc oxide, whose resistivity is strongly non-linear as a function of the applied voltage.

More precisely, such varistors allow almost no current to pass so long as the voltage across their terminals is less than a triggering threshold, and they allow very high currents of as much as several tens of kA to pass when the voltage applied across their terminals exceeds the above-mentioned triggering threshold.

The number of varistors used in the lightning arrester is such that the nominal operating voltage on the electricity line is lower than the triggering threshold across the terminals of the stack of varistors.

Thus, the lightning arrester can withstand the nominal operating voltage on a continuous basis without there being any leakage current, while also making it possible to drain off very high discharge currents that can appear temporarily over the line in the event of an accidental voltage surge occurring.

Numerous types of lightning arrester have already been proposed.

Indeed, the field of lightning arresters has generated very abundant literature.

Today, a known lightning arrester generally comprises:

- a stack of varistors;
- two contact parts made of an electrically conductive material and placed at respective ends of the stack of varistors; and
- a cover made of an electrically insulating material surrounding the stack of varistors.

The above-mentioned cover made of an electrically insulating material has itself been the subject of very abundant literature.

For example, Document GB-A-2 073 965 proposes making the cover from a heat-shrinkable material.

Documents U.S. Pat. No. 4,298,900, DE-A-3 001 934, DE-A-3 002 014 propose also placing an outer housing made of porcelain over the heat-shrinkable cover.

Documents U.S. Pat. No. 4,092,694 and U.S. Pat. No. 4,100,588 propose placing each varistor in a silicone-based ring, and disposing the resulting stack of varistors surrounded in this way inside a porcelain housing.

Document U.S. Pat. No. 2,050,334 proposes placing a stack of varistors in a porcelain housing and filling the space formed between the porcelain housing and the stack of varistors with a filler material formed, for example, of a halogenated compound based on wax.

Documents EP-A-0 008 181, EP-A-0 274 674, EP-A-0 231 245, and U.S. Pat. No. 4,456,942 propose making the cover around the varistors from an elastomer material, the cover being formed in particular by overmolding.

More precisely, Document EP-A-0 274 674 proposes molding a cover over a stack of varistors, which cover is made of a composite material based on elastomer, EPDM, silicone, or some other resin that may optionally be filled.

Document U.S. Pat. No. 4,161,012 also proposes disposing a cover made of elastomer over the varistors. That document proposes making the cover by depositing elastomer over the outside surfaces of the varistors, or by molding the cover over the varistors, or else by preforming the elastomer cover, and then inserting the varistors into said cover.

As early as 1958, Document U.S. Pat. No. 3,018,406 proposed making the cover in the form of two preformed complementary shells, and an outer cover of a plastics material injection molded over the varistors.

Document U.S. Pat. No. 3,586,934 proposes making the cover from a synthetic resin, e.g. a resin based on epoxy or on polyester, or even a silicone or polyester varnish.

Document EP-A-0 196 370 proposes making the cover over a varistor body by casting a synthetic resin formed, for example, of epoxy resin, of polymer concrete, of silicone resin, or of an elastomer, or by covering the varistor body with a shrinkable tube made of a plastics material, or else by providing the stack with a layer of synthetic resin.

Furthermore, Documents U.S. Pat. Nos. 4,656,555, 4,905,113, 4,404,614, EP-A-0 304 690, EP-A-0 335 479, EP-A-0 335 480, EP-A-0 397 163, EP-A-0 233 022, EP-A-0 443 286, and DE-A-0 898 603 propose making the cover surrounding the stack of varistors from composite materials made up of fibers, generally glass fibers, impregnated with resin.

More precisely, Document U.S. Pat. No. 4,656,555 proposes firstly forming a winding of fibers based on a plastics material, such as polyethylene, or based on glass, or even on ceramic, optionally impregnated with resin, e.g. epoxy resin, and then forming a housing over the outside of the winding, which housing is made of a weather-resistant polymer material, e.g. based on elastomer polymers, synthetic rubber, thermoplastic elastomers, or EPDM.

That document proposes more precisely either preforming the weather-resistant polymer housing, and then engaging the stack of varistors as provided with the fiber winding into the housing, or else firstly forming the fiber winding over the stack of varistors, and then making the weather-resistant polymer housing by molding it over the winding, by spraying polymer over the winding, or by inserting the stack of varistors as provided with the winding into a bath of polymer.

Document U.S. Pat. No. 4,404,614 proposes disposing the following successively over a stack of varistors: a first cover based on glass fibers impregnated with resin, e.g. epoxy resin, then a second cover based on glass flakes and on epoxy resin, and finally a resilient outer cover based on EPDM rubber or on butyl rubber.

That document indicates that the first cover, the second cover, and the outer cover may be put in place successively over the stack of varistors, or the covers may be formed in reverse order.

The document also mentions the possibility of molding the outer cover over the second cover based on glass flakes and on epoxy resin.

Document EP-A-0 233 022 proposes forming the following over a stack of varistors: a shell based on glass fibers reinforced with epoxy resin, then an elastomer-based cover that is heat-shrinkable or that can be released by equivalent mechanical means on said shell.

In a variant, the cover can be molded in situ and can be based on a synthetic resin or on a polymer material.

That document indicates that the shell may be preformed. That document also proposes to use a sheet of pre-impregnated fibers.

Document EP-A-0 304 690 proposes firstly making a filamentary winding of glass fibers impregnated with resin, then to form a coating of an elastomer material of the EPDM type over the outside of the winding by injection.

Document EP-A-0 355 479 proposes placing the following in succession on the stack of varistors: firstly a barrier formed of a film of plastic, e.g. based on polypropylene, then a winding of non-conductive filaments, and finally a housing made of weather-resistant elastomer.

Document EP-A-0 397 163 proposes placing the following in succession over the stack of varistors: a filamentary winding impregnated with resin, followed by a coating of elastomer, e.g. EPDM, over the winding, the coating being formed by injection.

The technique of using a composite material is very old. Indeed, as early as 1946, Document DE-A-0 898 603 proposed using glass fibers impregnated with resin for varistor covers.

More recently, Document FR-A-2 698 736 has proposed a method of manufacturing a lightning arrester, which method comprises steps consisting in making a stack of varistors, in forming a first cover of a composite material over the stack of varistors, which first cover is at least semi-rigid and is of outside section that is constant over its length, thereby compensating, in particular, for the surface unevenness of the stack of varistors due to alignment errors and to dispersion in varistor size, and in placing an outer cover provided with fins over the first cover of a composite material by extruding a substantially uniform outer cover over the first cover, then by mounting annular fins on the extruded outer cover.

Prior art lightning arresters have given good service.

However, the Applicant proposes to improve existing lightning arresters.

A main object of the present invention is to improve the reliability of existing lightning arresters, in particular by avoiding any presence of any gas at the interface(s) between the stack of varistors and the cover that covers them.

A less important object of the present invention is to reduce the cost of known lightning arresters.

To these ends, the present invention provides a method of manufacturing a lightning arrester, the method being of the type comprising steps consisting in:

making a stack of varistors; and forming a cover made of a composite material over the stack of varistors;

said method being characterized by the fact that the step of forming a cover made of a composite material consists in:

placing a woven fiber fabric on the outside of the stack of varistors and in contact herewith;

placing a flexible outer cover on the outside of the stack of varistors; and injecting a material suitable for impregnating the fiber fabric into the annular space formed between the stack of varistors and the flexible outer cover.

As becomes clear below, the method of the present invention makes it possible to expell all air from the interface between the stack of varistors and the flexible outer cover.

According to another advantageous characteristic of the invention, the outer cover is a cover provided with annular fins and having zones of higher rigidity at the fins.

According to another advantageous characteristic of the invention, the injected material is a thermoplastics material, and is advantageously a polyester.

According to another advantageous characteristic of the invention, the material is injected through bores provided in contact parts mounted on the ends of the stack of varistors.

According to another advantageous characteristic of the invention, the injection is performed by means of two bores provided in respective ones of the contact parts placed at the ends of the stack of varistors, which bores are diametrically opposite about the axis of the stack.

Figure 5:
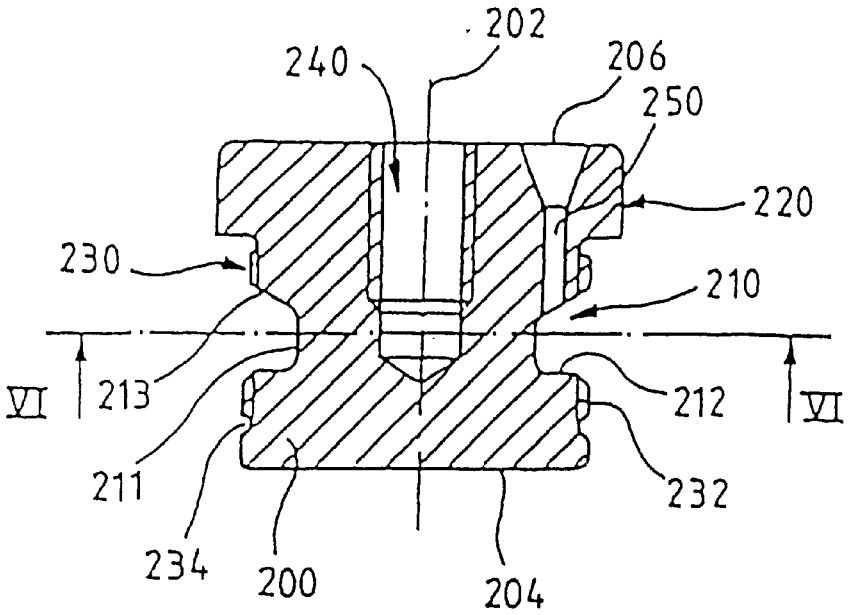
Figure 6:
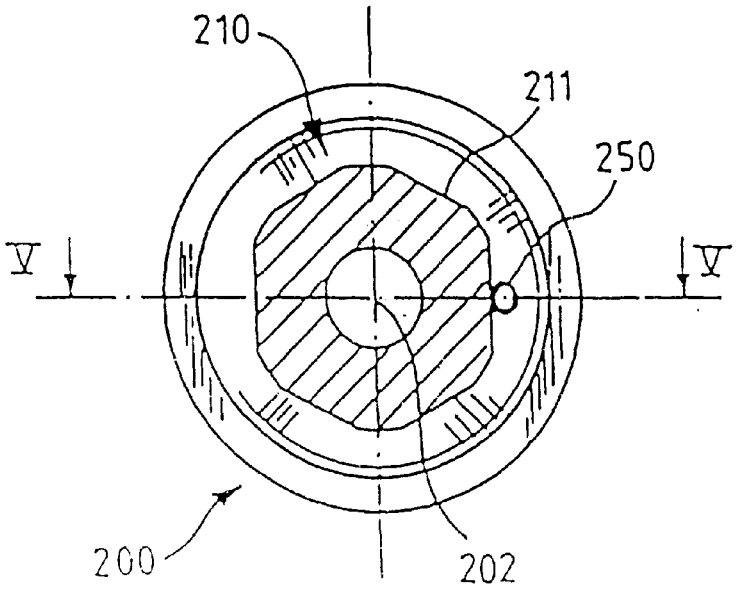

Other characteristics, objects, and advantages of the present invention appear on reading the following detailed description with reference to the accompanying drawings which are given by way of non-limiting example, and in which:

accompanying FIGS. 1 to 4 are diagrammatic views of the lightning arrester in longitudinal axial section, showing the various successive steps in making a preferred variant embodiment of a lightning arrester of the invention;

FIG. 5 is a diagrammatic view of a contact part of the present invention in longitudinal axial section on the plane referenced V—V in FIG. 6; and FIG. 6 is a view of the same contact part in cross-section on the plane referenced VI—VI in FIG. 5.

The lightning arrester of the present invention as shown in accompanying FIG. 4 and as obtained by means of the intermediate steps shown in FIGS. 1 to 3 and described below, comprises a stack of varistors 100, two contact parts 200, a cover 300 made of a composite material comprising a woven fiber fabric 310 and an injected material 350 impregnating the fiber fabric 310, and an outer cover 400 provided with fins.

If necessary, the lightning arrester may be supplemented by end caps made of an electrically conductive material and mounted on the ends of the lightning arrester. To simplify the illustrations, the caps, which contribute both to the electrical contact of the lightning arrester and to sealing thereof, are not shown in the accompanying Figures.

The varistors 100 are preferably formed of disks of constant diameter and based on zinc oxide.

Varistors based on zinc oxide are well known to the person skilled in the art.

The method of obtaining them and their composition are not therefore described below.

As shown in accompanying FIG. 1, the varistors 100 are firstly stacked up along their common axis 102 so that they are in alignment therealong.

If necessary, although not shown in the accompanying Figures, separators made of an electrically conductive material, e.g. disk-shaped, and optionally provided with resilient members, may be interposed between at least some of the adjacent pairs of varistors 100.

Figure 2:
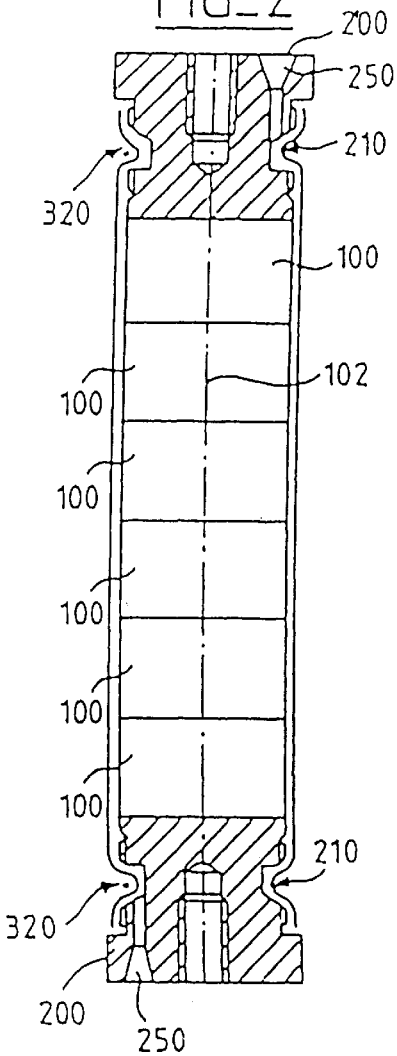

As shown in FIG. 2, once the stack has been formed, two contact parts 200 are placed at respective ends of the stack of varistors.

The shape of a particular and non-limiting embodiment of the contact parts 200 is described in detail below with reference to FIGS. 5 and 6.

At this point in the description, it should merely be noted that each of the contact parts 200 is provided with an annular groove 210 and with a longitudinal bore 250 that is parallel to the axis 202 of the part 200, that opens out in the outer surface 206 of the contact part at one end, and that opens out into and at the end wall of the groove 210 at the other end.

As shown in FIG. 2, after the stack of varistors 100 has been formed, a woven fiber fabric 310 is placed over the outside of the stack of varistors 100 and in contact therewith.

Preferably, the fabric 310 is woven from fibers, and most preferably from glass fibers, and is wound around the stack of varistors 100, and over the bases of the two contact parts 200.

More precisely, the fiber fabric 310 has mutually-orthogonal warp and weft fibers that are disposed respectively parallel to the axis 102 of the stack of varistors and transversely thereto.

The fiber fabric 310 typically has a mesh size of 3.5 mm×5 mm. The mesh size must be suitable for making it possible to remove the arc and/or the gas created by the arc in the event that the lightning arrester fails.

Preferably, two ties are tightened on the fiber fabric 310 facing the above-mentioned grooves 210.

More precisely, the two ties 320 placed in the form of loops in the grooves 210 come from a common tape that runs along the stack of varistors 100 over the outside of the fiber fabric 310. The tape may be wound spirally around the fiber fabric 310 between the two ties 320, or else it may extend rectilinearly parallel to the axis of the lightning arrester, over the outside of the fiber fabric 310 between the two ties 320, in which case the rectilinear tape is preferably placed facing the free edge of the fiber fabric 310. Thus, the tape performs a function of holding the fiber fabric 310 along the lightning arrester.

Figure 3:
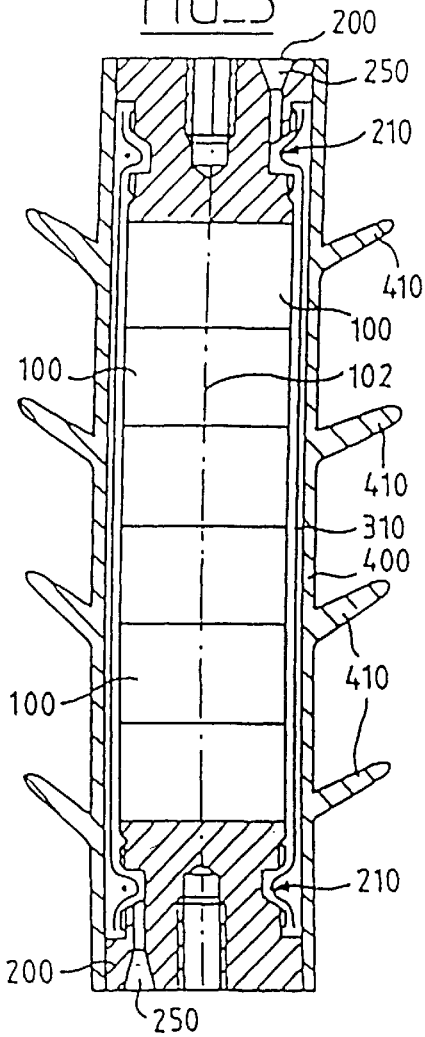
Figure 4:
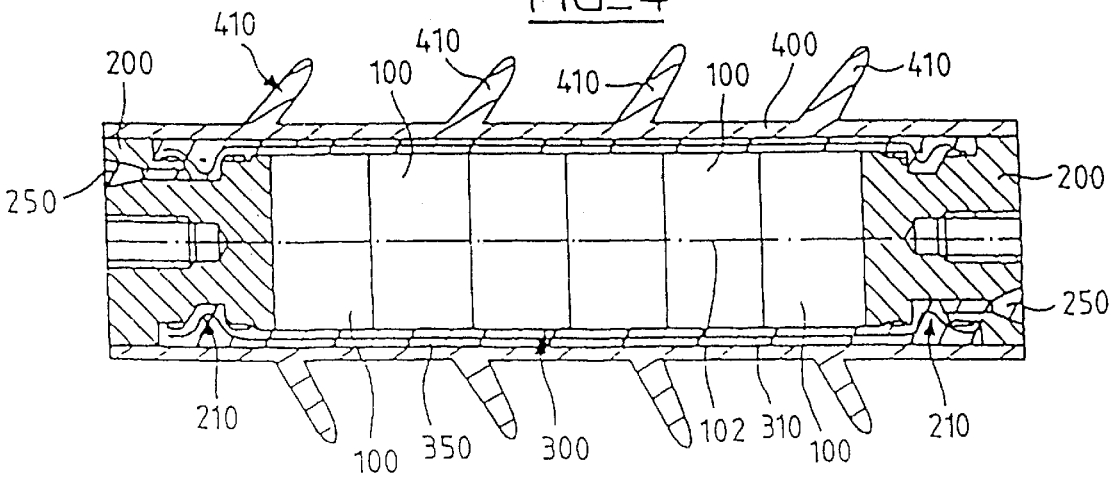

Then, as shown in FIG. 3, a flexible outer cover 400 is disposed on the outside of the stack of varistors 100 as equipped with the fiber fabric 310.

Preferably, and as shown in the accompanying Figures, the outer cover 400 is made of an elastomer, e.g. silicone, and has annular fins. Such outer covers having annular fins are well known to the person skilled in the art, and are therefore not described in detail below.

In a manner known per se, the purpose of the annular fins 410 is to lengthen the creepage distance over the outside of the lightning arrester. The number, profile, and spacing of the fins may be varied as a function of requirements concerning ability to withstand pollution, and, naturally, as a function of the nominal voltage of the lightning arrester.

It can be noted that such an outer cover 400 as provided with annular fins 410 is characterized by zones of higher rigidity at the fins 410.

Once the outer cover 400 has been put in place, a material suitable for impregnating the fiber fabric 310 is injected into the annular space formed between the stack of varistors 100 and the flexible outer cover 400.

The injected material 350 is preferably an epoxy resin, e.g. a polyester.

More precisely, the material is injected via the bores 250 formed in one of the contact parts 200, the bore 250 in the other part 200 serving to remove air.

Preferably, and as shown diagrammatically in the figures, the bore 250 provided in the other contact part 200 is positioned diametrically opposite from the bore 250 serving as an injection nozzle.

According to another advantageous characteristic of the invention, the material 350 is injected while the stack of varistors 100 is in the horizontal position or in a position in which it slopes slightly relative to the horizontal, e.g. at approximately in the range 35° to 45°.

However, in a variant, the lightning arrester may be made in the vertical position.

The resulting composite material formed by the fiber fabric 310 being combined with the injected material 350 provides a firm bond between the two contact pieces and, by applying axial stress, maintains good electrical contact firstly between the main faces 104 (extending transversely to the axis 102) of each pair of adjacent varistors, and secondly between respective ones of the contact parts 200 and the outer main faces 104 of the varistors placed at the ends of the stack.

In addition, the combination of fibers 310 plus injected material 350 of the present invention has the property of enabling the injected material to "volatilize" in the event that the lightning arrester fails, i.e. in the event that an electric arc is created, while leaving a fiber fabric which holds the lightning arrester together mechanically.

It should be noted that, by disposing the weft fibers so that they run parallel to the axis 102 of the lightning arrester, it is possible, when a force is applied transversely to the axis 102 to one of the ends of the lightning arrester, for some of the weft fibers to be subjected to elongation while the weft fibers that are diametrically opposite are subjected to compression.

Glass fibers in particular have excellent strength properties both in elongation and in compression.

They therefore impart good bending strength to the lightning arrester.

Numerous variants are possible for the tie 320 which may, for example, be formed by a resin-impregnated tape of fibers.

Putting the ties 320 in place makes it possible to hold the fiber fabric 310 firmly so as to prevent it from moving in translation over each of the contact parts 200, thereby guaranteeing that the contact parts 200 are prevented from moving in translation relative to each other.

The fiber fabric 310 may be formed of various superposed sheets of fibers.

In a particular and non-limiting embodiment, the pitch of the fins 410 is about 24 mm.

The use of an elastomer cover 400 subdivided into flexible zones between two fins 410 and into more rigid zones facing the fins makes it possible to generate the following two phenomena on injecting the material 350.

Firstly, the presence of more rigid annular zones on the outer cover 400 causes headloss to vary, thereby enabling the resin 350 injected via the bore 250 to wet of the fiber fabric 310 uniformly in an annular direction. The flow of resin 350 causes the flexible zones between two fins 410 to deform. Thus, if an offset occurs in the progression of the resin 350, then the resin is braked when it arrives at a more rigid annular zone facing a fin 410, thereby making it possible to return to an annular injection stream that is of substantially constant section.

Such levelling takes place every time the resin goes past a fin 410, thereby preventing any drift of the flow, which could cause an air bubble to be trapped, such an air bubble being subsequently difficult to remove.

Furthermore, the headloss varies continuously as the material 350 progresses, thereby causing local variations to occur in the deformation of the flexible zone between two fins. This deformation causes the resin 350 to be urged radially towards the inside of the stack of varistors, so that the resin wets the fiber fabric 310 during injection. In addition, such urging, which is of the peristaltic type, also takes place after injection, when the outer cover 400 pushes away any surplus fluid on resiliently returning to its initial shape.

On removing the surplus fluid, it is observed that small bubbles of residual gas can escape via the second bore 250 from the annular space defined between the stack of varistors and the outer cover 400.

It should also be noted that, by injecting the material 350 into the trough of the annular groove 210 and by removing the resin in like manner from the opposite end of the stack, the fibers disposed in the annular groove zone are forced to be completely wetted, this zone being particularly difficult to impregnate because it corresponds to an annular section that is larger and that has a higher concentration of fibers.

In non-limiting manner, the polyester material 350 is injected under a pressure of about 2 bars.

It should also be noted that the provisions of the present invention, in particular the fact that injection takes place through an outer cover 400 that has zones of higher rigidity, make it possible to produce the following effects:

- the uniformity of the material 350 is improved because it is temporarily held back as a result of the presence of the zones of higher rigidity corresponding to the fins 410, including when the material 350 is obtained by mixing two fluids upstream from the injection site; and
- the risk that any fillers contained in the material 350 might settle out is reduced for the same reasons.

If necessary, a compound such as a silicone resin is also injected via one of the bores 250 into the annular space between the outer cover 400 and the stack of varistors 100, such a compound making it possible to improve the bonding between the injected polyester material and the silicone outer cover 400.

In another variant, it is possible, prior to injection, to effect mechanical treatment, e.g. abrasion, sand-blasting, etc., inside the silicone outer cover 400, or even chemical treatment, or else to deposit a primer enabling chemical bridging to be obtained between the silicone of the cover 400 and the injected material 350.

It should also be noted that the present invention enables lightning arresters to be made under cost conditions that are particularly favorable, in particular because all of the manufacturing steps can be performed without requiring controlled atmospheres.

A particular embodiment of the contact part 200 of the invention is described in more detail below with reference to the FIGS. 5 and 6.

Preferably, the two contact parts 200 placed at respective ends of the lightning arrester are identical.

Each contact part 200 is formed of a single block of metal that is generally circularly symmetrical about an axis 202.

In use, this axis 202 coincides with the axis 102 of the stack of varistors.

In FIG. 5, the main faces of the contact part 200 are referenced 204 and 206.

These main faces 204 and 206 are plane and are orthogonal to the axis 202.

In use, the main face 204 rests on the outer main face 104 of a varistor 100 placed at the end of the stack.

The main face 206 faces towards the outside of the lightning arrester.

The contact part 200 comprises a cylinder 220 adjacent to the main face 206 and extended towards the main face 204 by a drum 230 of smaller section.

Preferably, the section of the drum 230 is equal to the outside section of the varistors 100.

Thus, when the contact parts 200 are placed on the stack of varistors 100, the drum 230 extends the outside surface of the stack.

The above-mentioned annular groove 210 is provided in the drum 230, substantially half way along it.

The end wall 211 of the groove 210 is preferably of poylgonal section, e.g. of hexagonal section as shown in FIG. 6.

The first flank 212 of the groove 210, which flank is closer to the main face 204, is preferably plane and perpendicular to the axis 202.

The second flank 213 of the groove 210, which flank is closer to the main face 206, is preferably conical, with the cone being centered on the axis 202, and having its concave side facing the main face 206.

Furthermore, helical threads 232 are formed on the outside surface of the drum 230.

Preferably, the threads 232 extend on either side of the groove 210.

However, the threads 232 are advantageously interrupted before they reach the main face 204.

The threads 232 are terminated in the vicinity of the main face 204 by an annular nick 234.

Each contact part 200 has a tapped blind bore 240 centered on the axis 202 and opening out in the main face 206.

The tapped bore 240 is designed to receive a connection screw.

The polygonal end wall 211 of the groove 210 and the threads 232 form structures that are not circularly symmetrical about the axis 202.

When these structures are engaged in the cover 300, they make it possible to prevent the contact parts 200 from rotating relative to the cover 300.

Furthermore, the annular grooves 210, in which the ends of the layer of fabric forming the cover 300 are engaged, make it possible to provide stable fixing so that said cover 300 is prevented from moving in translation relative to the contact parts 200.

Finally, each part 200 is provided with a bore 250 that is parallel to the axis 202, and that connects the outer face 206 to the groove 210 at the end wall thereof.

In conclusion, the structure described above and shown in the accompanying Figures makes it possible to obtain excellent rigidity for the lightning arrester, preventing it from bending, from rotating about the axis 102 of the stack, and from moving in relative translation along said axis.

If necessary, in a variant, it is possible to consider forming zones of weakness in the outer cover 400.

In a variant, the lightning arrester of the present invention may be provided with a fault-indicating device.

Such a device may be placed, for example, at one end of the lightning arrester.

Such a fault-indicating device is designed to indicate that a line current is flowing to ground via the lightning arrester, i.e. that a leakage current is flowing through the lightning arrester.

The Applicant has already described and shown such a fault-indicating device in French Patent Application FR-A-2 685 533.

For this reason, such a fault-indicating device is not described in detail below.

It should however be noted that such a fault-indicating device preferably comprises:

- a screw centered on the axis 102 of the stack of varistors and connected electrically to one of the contact parts 200;
- a low-loss current sensor comprising a winding surrounding the screw;
- an electronic circuit comprising:
  1. a rectifier bridge whose inputs are connected to the winding; and
  2. a capacitor connected to the outputs of the rectifier bridge to integrate the energy from the detected leakage current; and
- an indicator assembly, e.g. based on pyrotechnic components, designed to be initiated by the energy integrated in the capacitor.

In another variant, the fault detector may be based on the principle of increasing the volume of the cover 400 when the lightning arrester short-circuits. Since such a detector is also known per se, it is not described in detail below.

The lightning arrester of the present invention offers numerous advantages compared with prior lightning arresters.

Firstly, the present invention makes it easy to adapt the length of the lightning arrester to the nominal voltage of the line to be protected.

The present invention requires no adaptation of any mold whatsoever.

The present invention makes it possible to avoid any layer of air or gaseous inclusion at the interface between the stack of varistors 100 and the cover 400, and therefore makes it possible to avoid any surface discharge at that level.

Naturally, the present invention is not limited to the above-described particular embodiment, but rather it extends to any variant lying within the spirit of the invention.

Thus, for example, it is possible to use a fabric 310 of fibers that are pre-impregnated with a resin, the fabric being placed outside the stack of varistors 100 prior to injecting the material 350 into the annular space formed between the stack of varistors 100 and the flexible outer cover 400.

In a variant, each bore 250 may be closed off, e.g. by means of a stopper or of a sealing compound, so as to complete the sealing of the lightning arrester, once injection of the material 350 is finished.

According to another advantageous characteristic of the invention, it is possible to make provision to place a film that is impermeable to the injected resin 350 around the stack of varistors 100 prior to the injection step. Such a film makes it possible to prevent resin from penetrating between two varistors 100.

Such a film may be installed only at each interface between two adjacent varistors 100 and between the end varistors and the contact parts 200, or else it may cover in one piece the entire active portion formed by the stack of varistors 100.

In another variant, it is possible to provide contact parts 200 each having a plurality of bores 250 both for injecting the material 350 into the annular space formed between the stack of varistors 100 and the flexible outer cover 400, and for removing air and surplus material therefrom.

What is claimed is:

1. A method of manufacturing a lightning arrester, comprising:

making a stack of varisters;

placing a woven fiber fabric on the outside of the stack of varisters and in contact therewith;

placing a flexible outer layer on the outside of the woven fiber fabric; and injecting a material suitable for impregnating the fiber fabric through a bore into the annular space formed between the stack of varisters and the flexible outer layer so as to form a cover made of a composite material over the stack of varisters by impregnating the fiber fabric with the injected material.

2. A method according to claim 1, wherein the outer cover is a cover provided with annular fins defining zones of higher rigidity than said cover disposed around the stack of varistors.

3. A method according to claim 1 wherein the impregnation material is injected through contact parts placed at the ends of the stack of varistors.

4. A method according to claim 1 wherein the impregnation material is a synthetic resin.

5. A method according to claim 4, wherein the impregnation material is injected via at least one bore provided in a contact part at a first end of the stack of varistors, the contact part at the second end of the stack of varistors being provided with at least one corresponding bore for removing air contained in said annular space prior to injection.

6. A method according to claim 1 further comprising a prior step consisting in treating the inside surface of the flexible outer cover, thereby providing chemical bridging between the material of the flexible outer cover and the injected material.

7. A method according to claim 1 wherein the impregnation material contains a compound suitable for reinforcing the bond between the injected material and the outer cover.

8. A method according to claim 1 wherein the outer cover is made of an elastomer.

9. A method according to claim 5, wherein the bores formed in the end contact parts for injection purposes open out in respective annular grooves provided in the contact parts.

10. A method according to claim 1 wherein the fiber fabric has fibers parallel to the axis of the stack of varistors, and fibers transverse thereto.

11. A method according to claim 1 wherein the fiber fabric has a mesh size approximately in the range 3.5 mm to 5 mm.

12. A method according to claim 1 wherein the fiber fabric, placed on the outside of the stack of varistors prior to injecting the material into the annular space formed between the stack of varistors and the flexible outer cover is a fabric that is pre-impregnated with resin.

13. A method according to claim 5 further comprising closing off each injection bore, so as to complete the sealing of the lightning arrester once injection of the material is finished.

14. A method according to claim 1 further comprising placing two ties in the form of loops into grooves provided in contact parts disposed at the ends of the stack of varistors, on the outside of the fiber fabric to hold said fabric.

15. A method according to claim 14, wherein the two ties come from a common tape that runs along the stack of varistors over the outside of the fiber fabric.

16. A method according to claim 15, wherein the tape is wound spirally around the fiber fabric between the two ties.

17. A method according to claim 16, wherein tape extends rectilinearly parallel to the axis of the lightning arrester, over the outside of the fiber fabric between the two ties, preferably facing the free edge of the fiber fabric.

18. A method according to claim 1 further comprising placing a film that is impermeable to the injected resin around the stack of varistors prior to the injection step.

19. A method according to claim 4, wherein the impregnation material is an epoxy resin.

20. A method according to claim 4, wherein the impregnation material is a polyester resin.

21. A method according to claim 5, wherein the bore provided in the second part is diametrically opposite from the injection bore.

22. A method according to claim 6, wherein treating consists in applying a mechanical treatment.

23. A method according to claim 6, wherein treating consists in applying a chemical treatment.

24. A method according to claim 6, wherein treating consists in depositing a primer.

25. A method according to claim 8, wherein the outer cover is made of silicone rubber.

26. A method according to claim 13, wherein said injection bore is closed by means of a stopper.

27. A method according to claim 13, wherein said injection bore is closed by means of a sealing compound.

28. A method of manufacturing a lightning arrester, comprising:

making a stack of varistors;

forming a cover made of a composite material over the stack of varistors by placing a woven fiber fabric on the outside of the stack of varistors and in contact therewith; and placing a flexible outer cover on the outside of the woven fiber fabric, wherein for forming said cover made of a composite material, the method further comprises:

injecting a synthetic resin suitable for impregnating the fiber fabric into the annular space formed between the stack of varistors and the flexible outer cover, via at least one bore provided in a contact part at a first end of the stack of varistors, the contact part at the second end of the stack of varistors being provided with at least one corresponding bore for removing air contained in said annular space prior to injection.

29. A method according to claim 28, wherein the bore provided in the second contact part is diametrically opposite from the injection bore.

30. A method according to claim 28, wherein the bores formed in the end contact parts for injection purposes open out in respective annular grooves provided in the contact parts.

31. A method according to claim 28 further comprising closing off each injection bore, so as to complete the sealing of the lightning arrester once injection of the material is finished.

* * * * *